US009271559B2

(12) United States Patent
Gleason

(10) Patent No.: US 9,271,559 B2
(45) Date of Patent: Mar. 1, 2016

(54) BODY ARMOR SUPPORT HARNESS

(75) Inventor: Paul Ryan Gleason, Bozeman, MT (US)

(73) Assignee: Mystery Ranch Limited, Bozeman, MT (US)

( * ) Notice: Subject to any disclaimer, the term of this patent is extended or adjusted under 35 U.S.C. 154(b) by 631 days.

(21) Appl. No.: 13/220,483

(22) Filed: Aug. 29, 2011

(65) Prior Publication Data

US 2013/0047320 A1 Feb. 28, 2013

(51) Int. Cl.

| | |
|---|---|
| ***A45F 3/06*** | (2006.01) |
| ***F41H 1/02*** | (2006.01) |
| ***A45F 3/14*** | (2006.01) |
| *A45F 3/04* | (2006.01) |
| *A45F 5/00* | (2006.01) |
| *A45F 3/00* | (2006.01) |

(52) U.S. Cl.

CPC ... *A45F 3/06* (2013.01); *A45F 3/14* (2013.01); *F41H 1/02* (2013.01); *A45F 3/005* (2013.01); *A45F 5/00* (2013.01); *A45F 2003/045* (2013.01); *A45F 2003/146* (2013.01)

(58) Field of Classification Search

CPC ..... A41D 31/0055; A41D 1/04; A41D 13/00; A41D 13/0531; A41D 2600/00; F41H 1/02; A45F 3/06; A45F 3/14; A45F 3/005; A45F 5/00; A45F 2003/045; A45F 3003/146

USPC ..... 2/456, 455, 462, 467, 44, 92, 267, 2.5; 224/153, 636, 635, 637, 642, 648

See application file for complete search history.

(56) References Cited

U.S. PATENT DOCUMENTS

| | | | | | |
|---|---|---|---|---|---|
| 1,316,915 | A | * | 9/1919 | Steinert | 602/19 |
| 3,452,362 | A | * | 7/1969 | Korolick et al. | 2/2.5 |
| 4,175,553 | A | * | 11/1979 | Rosenberg | 602/19 |
| 4,318,502 | A | * | 3/1982 | Lowe et al. | 224/153 |
| 4,479,595 | A | | 10/1984 | Opsal | |
| 4,497,069 | A | * | 2/1985 | Braunhut | 2/2.5 |
| 4,504,002 | A | | 3/1985 | Hall | |
| 4,858,797 | A | * | 8/1989 | Rabska | 224/162 |
| 5,114,059 | A | | 5/1992 | Tatcher | |
| 5,127,610 | A | * | 7/1992 | Provasoli | 244/151 R |
| 5,328,447 | A | * | 7/1994 | Kapounek et al. | 602/19 |
| 5,487,498 | A | | 1/1996 | Gleason | |
| 5,722,940 | A | * | 3/1998 | Gaylord et al. | 602/19 |
| 5,724,707 | A | * | 3/1998 | Kirk et al. | 24/3.7 |
| 5,725,139 | A | * | 3/1998 | Smith | 224/637 |
| 5,823,414 | A | * | 10/1998 | Gal et al. | 224/637 |
| 5,954,250 | A | * | 9/1999 | Hall et al. | 224/262 |
| 6,098,196 | A | * | 8/2000 | Logan | 2/2.5 |

(Continued)

FOREIGN PATENT DOCUMENTS

| | | |
|---|---|---|
| DE | 3843597 | 12/1988 |
| EP | 1506724 | 2/2005 |

(Continued)

*Primary Examiner* — Alissa L Hoey

(74) *Attorney, Agent, or Firm* — Darren J. Jones; Lowe Graham Jones PLLC

(57) ABSTRACT

A hip harness for supporting upper body armor. The harness includes a hip belt, a frame, and a coupler. The hip belt is securable about the hips of a user of the body armor. The frame provides flexible support and has a lower end secured to the rear portion of the hip belt. The coupler is adjustably securable to the upper end of the frame. It has strips that fit through attachment loops on the back of the body armor to secure the harness to the armor.

26 Claims, 7 Drawing Sheets

(56) References Cited

U.S. PATENT DOCUMENTS

| | | | | |
|---|---|---|---|---|
| 6,233,740 | B1 * | 5/2001 | Meyers et al. | 2/102 |
| 6,282,717 | B1 * | 9/2001 | Ng | 2/70 |
| 6,427,695 | B1 * | 8/2002 | Zanetti et al. | 128/846 |
| 6,634,533 | B2 * | 10/2003 | Thompson et al. | 224/641 |
| 7,047,570 | B2 * | 5/2006 | Johnson | 2/102 |
| 7,266,850 | B1 * | 9/2007 | Strum et al. | 2/2.5 |
| 7,287,677 | B2 * | 10/2007 | Reid | 224/637 |
| 7,490,358 | B1 | 2/2009 | Beck | |
| 7,673,777 | B2 | 3/2010 | Gleason, Jr. | |
| 7,748,053 | B1 * | 7/2010 | Hancock | 2/2.5 |
| 7,917,967 | B2 * | 4/2011 | Osborne | 2/2.5 |
| 7,987,523 | B2 * | 8/2011 | Cole et al. | 2/102 |
| 8,330,133 | B2 * | 12/2012 | Gold et al. | 250/516.1 |
| 8,336,124 | B2 * | 12/2012 | Crelinsten et al. | 2/455 |
| 8,459,518 | B2 * | 6/2013 | Demsky | 224/576 |
| 8,490,212 | B1 * | 7/2013 | Asher et al. | 2/2.5 |
| 8,572,762 | B2 * | 11/2013 | Herbener et al. | 2/2.5 |
| 8,635,714 | B2 * | 1/2014 | Hazlett | 2/311 |
| 2002/0074373 | A1 * | 6/2002 | Heinz et al. | 224/637 |
| 2002/0108982 | A1 | 8/2002 | Mydans | |
| 2005/0010987 | A1 * | 1/2005 | Crye et al. | 2/2.5 |
| 2006/0151559 | A1 * | 7/2006 | Gravseth | 224/637 |
| 2006/0289589 | A1 * | 12/2006 | Gregory | 224/631 |
| 2008/0010730 | A1 * | 1/2008 | Twito et al. | 2/463 |
| 2008/0179367 | A1 * | 7/2008 | Storey | 224/637 |
| 2008/0257922 | A1 * | 10/2008 | Cragg | 224/269 |
| 2009/0057360 | A1 * | 3/2009 | Demsky | 224/262 |
| 2010/0037374 | A1 * | 2/2010 | Crelinsten et al. | 2/455 |
| 2010/0076359 | A1 * | 3/2010 | Glenn | 602/19 |
| 2010/0088799 | A1 * | 4/2010 | Carter | 2/102 |
| 2010/0152636 | A1 * | 6/2010 | Parks et al. | 602/19 |
| 2010/0243694 | A1 * | 9/2010 | Oddou et al. | 224/633 |
| 2010/0294820 | A1 | 11/2010 | Neibarger | |
| 2011/0114684 | A1 * | 5/2011 | Ya'akobovich et al. | 224/259 |
| 2011/0179553 | A1 * | 7/2011 | Hazlett | 2/311 |
| 2011/0231976 | A1 * | 9/2011 | Herbener et al. | 2/2.5 |
| 2012/0180178 | A1 * | 7/2012 | Gallo | 2/2.5 |
| 2012/0192335 | A1 * | 8/2012 | Crye | 2/102 |
| 2013/0227769 | A1 * | 9/2013 | Kordecki | 2/459 |
| 2013/0256358 | A1 * | 10/2013 | Beck | 224/641 |

FOREIGN PATENT DOCUMENTS

| | | | | |
|---|---|---|---|---|
| EP | 1842449 | | 10/2007 | |
| WO | WO 2008127784 | A2 * | 10/2008 | F41H 1/02 |
| WO | WO2011002784 | | 1/2011 | |

* cited by examiner

BODY ARMOR SUPPORT HARNESS

FIELD OF THE INVENTION

The present invention relates to support harnesses for carrying loads, and more particularly, to a hip belt support for body armor.

BACKGROUND OF THE INVENTION

Armor plates have been widely adopted for use by armed forces, particularly when in combat situations. The plates may be constructed of various materials, but are usually quite heavy, as they are typically constructed of a thick ceramic material. Thus a standard combination of plates worn in a vest may weigh between 20 to 36 pounds. The plates are held in a vest shell with hook-and-loop style closures holding the plates within the shell. The shell is constructed of a high denier nylon material and includes attachment loops such as "PALS" or "MOLLE" loops for optionally securing other items to the exterior of the vest, such as holsters or pouches. The weight of the armor-plate-loaded vest is primarily borne by the shoulders of the wearer, although a stretch panel may tighten the vest about the abdomen of the wearer to reduce the vest (and armor panels therein) from shifting about during active use. Carrying the weight of the armor vest in this manner can be quite tiring, given the weight and inflexibility of the armor plates.

SUMMARY OF THE INVENTION

The present invention provides additional support for heavy upper-body armor that is typically worn as a vest. It provides the advantage of transferring a portion of the load/weight of the armor to the hips of the user with a harness that is supportive, yet somewhat flexible. It also attaches to the armor without modifications to or interference with the armor vest itself.

The body armor typically includes a back protective element with a forward facing side (facing the back of the user) and a rearward facing side (facing away from the user). The preferred embodiment of the harness includes a hip belt, a frame, and a coupler. The frame is coupled to a rear portion of the hip belt and configured to extend adjacent the rearward facing side of the back protective element. The coupler is secured to the frame and is attachable to the body armor on the rearward side of the back protective element.

In one aspect of the preferred embodiment, the frame is adjustably secured to the coupler, the coupler being positionable in a plurality of vertical positions relative to the frame and to the hip belt. The frame is also preferably adjustably secured to the hip belt, the frame being positionable in a plurality of vertical positions relative to the hip belt. In one aspect of the invention, the hip belt includes a sleeve into which a lower end of the frame extends.

The frame includes frame stays extending generally vertically along most of the length of the frame, the frame stays being flexible. The frame stays are preferably constructed of composite material. The frame also includes a plastic panel at least partially covered by a fabric. Other frame constructions and materials are envisioned. For example, pre-preg composites, molded plastics, rigid or semi-rigid foam.

The coupler includes a sleeve into which the frame is secured. A hook-and-loop fastener is stitched inside the sleeve to secure the frame. The rearward facing side of the armor includes attachment loops and the coupler includes strips for extending through the attachment loops. In this manner the coupler is secured to the back of the armor. The coupler includes a sleeve into which the frame extends. The coupler also includes a semi-rigid plastic panel supporting its shape. As with the frame other constructions and materials may alternatively be employed.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

The present invention supports heavy upper body armor by transferring a portion of the load to the wearer's hips. The load transfer is accomplished in a manner such that the standard armor still fits the user in essentially the same manner, without harness members coming between the user and the armor. The harness of the present invention also allows flexibility for torso movement while providing upward support. It may be selectively attached and used as desired and is adjustable to fit a wide range of users and armor without interfering with the function of the armor or movement of the user.

The heavy ceramic plate members, by being bound together, form an upper frame structure about the upper torso of the user. By connecting the hip belt support to the plate members on the outside of the armor, the frame and user interface between plates and the user is maintained. The support harness takes load and weight from the rear plate and thereby stabilizes the front plate by its interconnection to the rear plate. Thus, the support harness of the present invention may be attached to the outside of the plates instead of the inside of the plates. In this way the armor, often including Kevlar® layers, is able to be used in its intended fashion, next to the body of the wearer.

Figure 1:
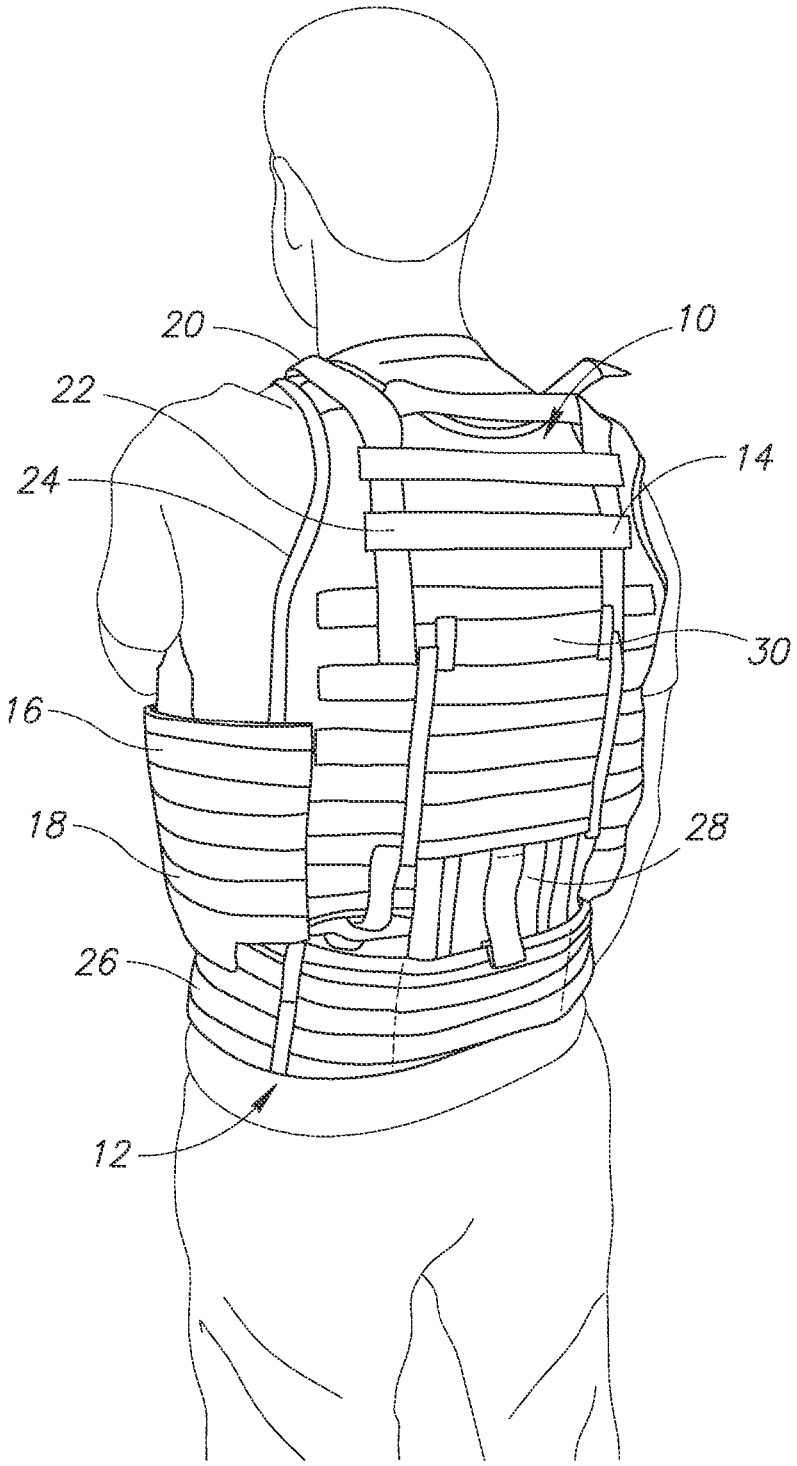
FIG. 1 is a rear perspective view of the support harness of the present invention on the back of a user.

FIG. 1 illustrates a body armor vest 10 being worn by a user. A harness 10 is secured about the hips of the user and to vest 10. Vest 10 is generally typical of body armor being used by armed forces, such as military forces for combat situations. Vest 10 includes a rear plate carrier 14 and a front plate carrier 16. Carriers 14 and 16 hold heavy armor plates, such as ceramic plates. Vest 10 may also include side plate carriers 18 having envelopes for side armor. Side plate carriers may be secured to the rear plate carrier 14 with an elastic strap section such that vest 10 can be secured snuggly to the user. This snug securement can also help transfer the load evenly about vest 10. Shoulder straps 20 extend from the top of rear plate carrier 14 to the top of front plate carrier 16, and normally include adjustment straps. A heavy load on shoulder straps 20 can cause excess fatigue to the wearer.

The standard body armor vest includes attachment loops 22 as shown in FIG. 1. These loops are standard "MOLLE" or "PALS" loops used for attachment of external pouches or other carriers. Loops 22 are typically created with woven nylon straps bar tacked at intervals to the vest carrier material. Bar tacks 24 on the strip at spaced intervals creates loops 22.

Harness 12 includes a hip belt 26 about the waist/hips of the user, a frame 28 extending up from the hip belt, and a coupler 30 secured to an upper portion of frame 28 and to the back of rear plate carrier 14. With this preferred arrangement, harness 12 can bear much of the load of vest 10 and the attachments thereto.

Figure 2A:
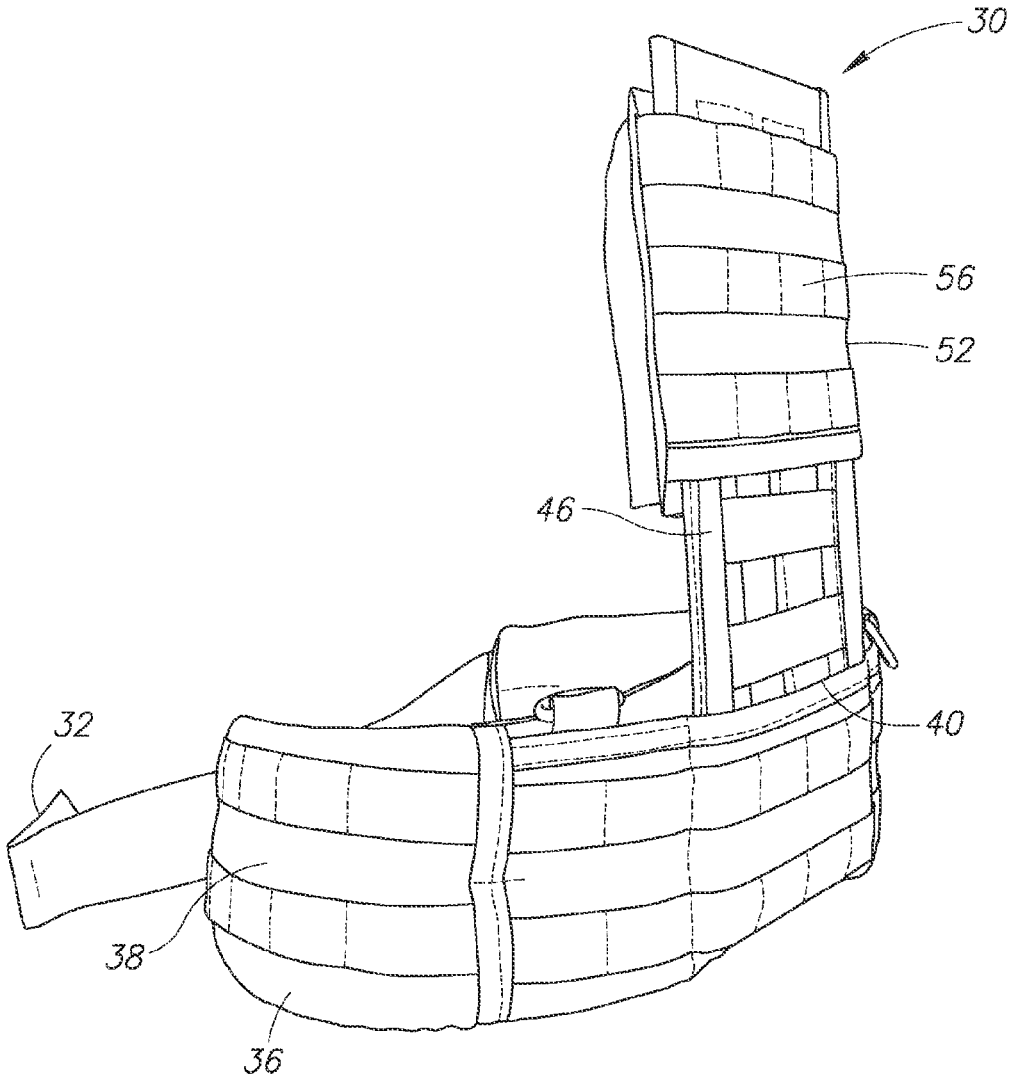
FIG. 2*a* is a rear perspective view of the harness.
Figure 2B:
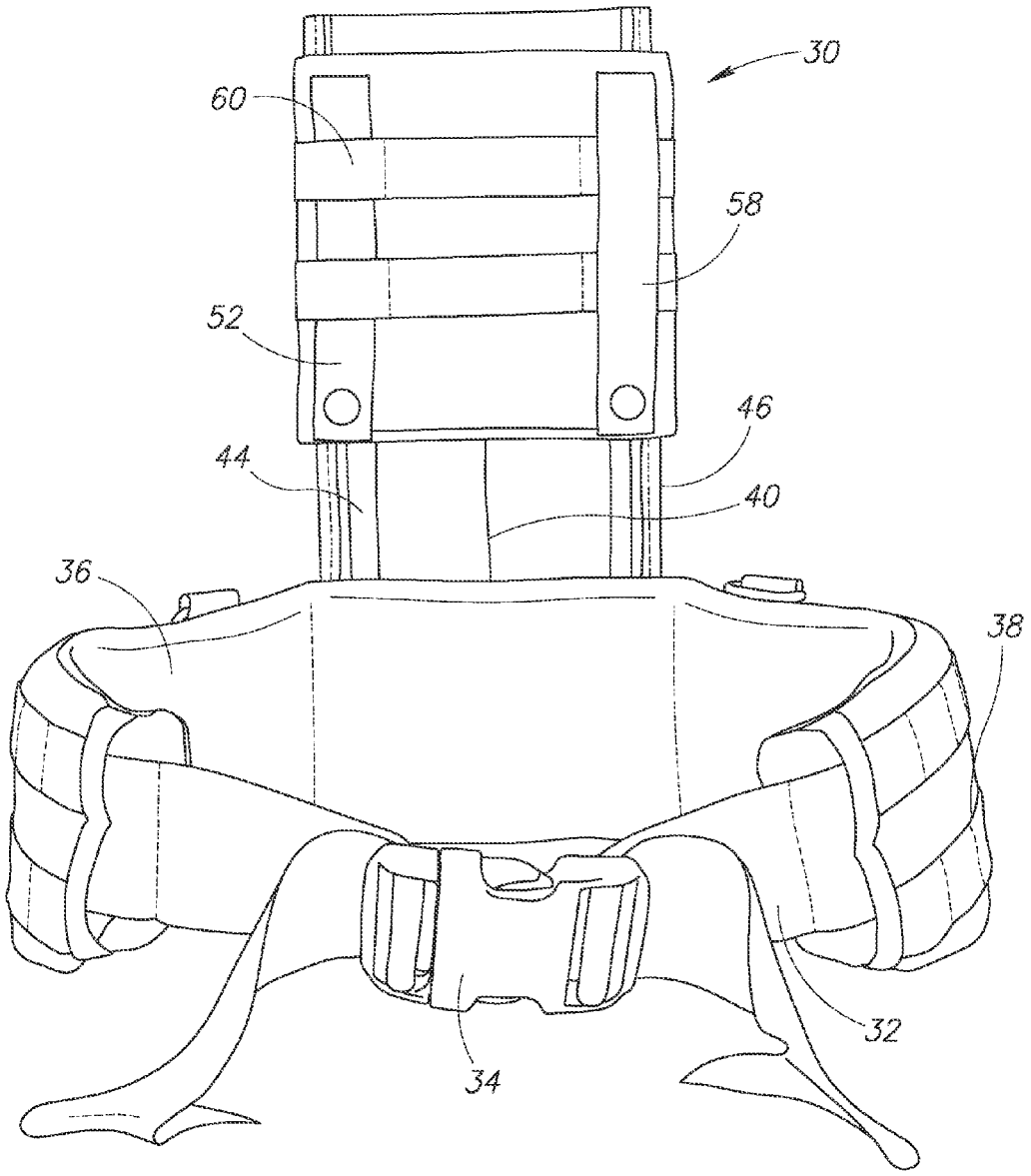
FIG. 2*b* is a front view of the harness.
Figure 3A:
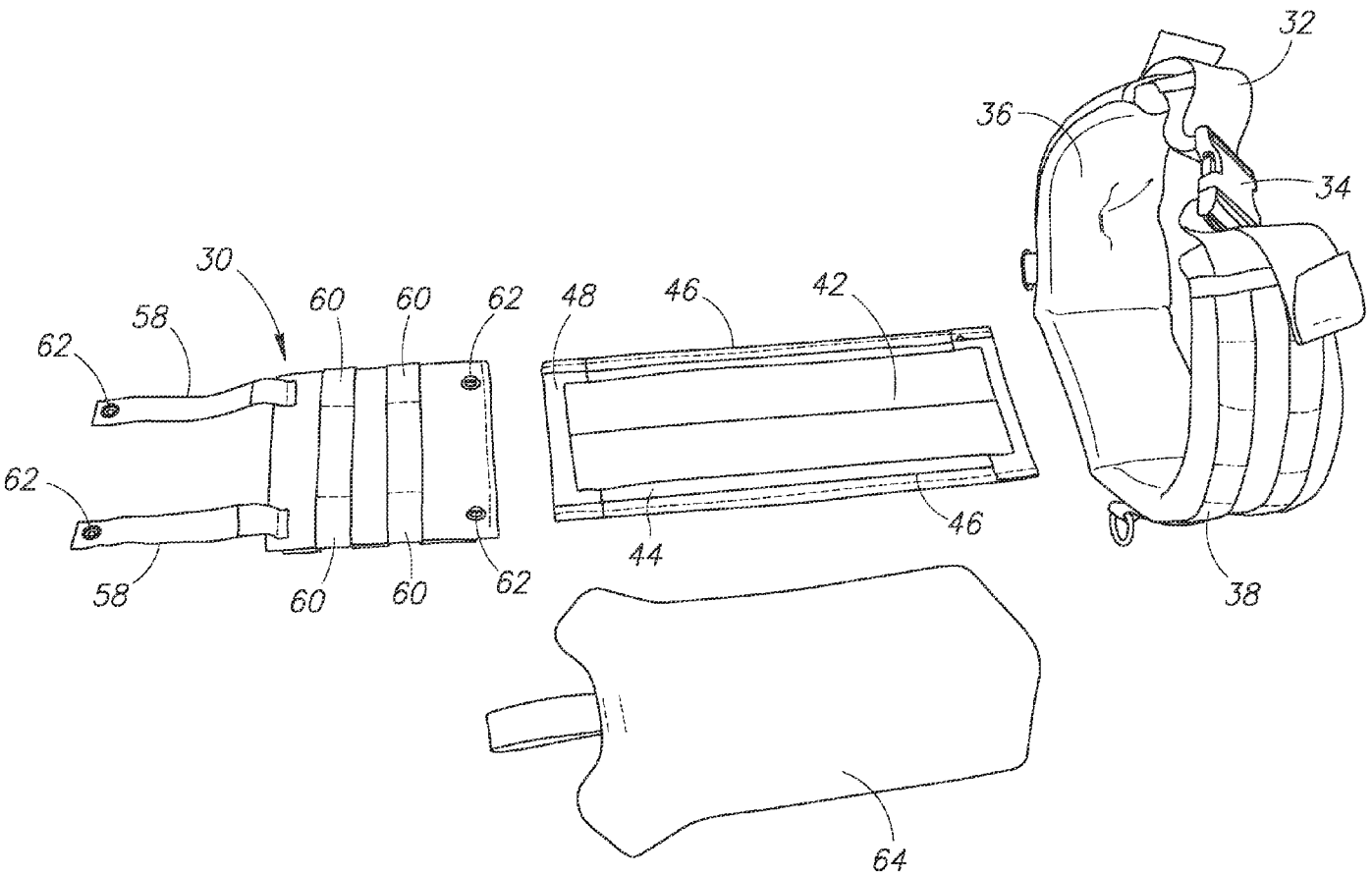
FIG. 3*a* is a front exploded view of the harness.

FIGS. 2 and 3 illustrate assembled and exploded views of harness 12 removed from vest 10. Hip belt 26 is preferably quite similar to a standard hip belt for a large backpack. It varies in some respects to accommodate the support to body armor vest 10. Hip belt 26 includes a strap 32 with a clasp 34 to allow strap adjustment for the size of the user. A pad 36 is fixed to strap 32 to provide supportive, cushioned positioning on the wearer. Pad 36 preferably includes belt attachment loops 38 on the outer sides thereof for attachment of other items in a similar fashion as on vest 10. The rear portion of hip belt 26 includes a sleeve 40 preferably rearward of pad 36. In one embodiment, sleeve 40 is constructed of the same nylon material as the outer layer on the remainder of pad 36. An extra layer of material is stitched in place over a rear region of pad 36 with an opening at the top. In an alternate embodiment sleeve 40 also has an opening at the bottom. The width of sleeve 40 is such as to allow a close fit with frame 28. Inside of sleeve 40 is positioned the hook portion of a hook-and-loop fastener 42, such as Velcro®.

Frame 28 provides support to transfer a portion of the load from vest 10 to hip belt 26, while still allowing movement of the hips of the wearer relative to the body armor. Frame 28 includes a frame sheet 44, frame stays 46, and a frame cover 48. Frame sheet 44 is preferably a rectangular sheet of high-density polyethylene plastic. In alternate embodiments molded components or composites may be used. Molded Kevlar or Dyneema® (a high-density polyethylene) or other protective materials or fabrics may be used in the frame for additional protection. Frame stays 46 are secured along the long edges of frame sheet 44 with a strip of woven nylon stitched over frame cover 48 to encapsulate the stays. Frame stays 46 are preferably constructed of composite fiberglass, but may alternatively be other materials such as carbon fiber or metal. The stays provide structural support and a good vertical load path, while allowing flexibility, both in bending and overall controlled twisting movement of frame 28 as the user moves, and specifically as the user's hips move relative to his/her upper body. Frame cover 48, in the preferred embodiment, is stitched over the backside and onto the front side of frame sheet 44. It includes frame attachment loops on the backside thereof, between stays 46. The upper end of frame 28 slides snuggly within coupler 30, while the lower end of frame 28 slides snuggly within sleeve 40 of hip belt 26. Hook-and-loop fastener preferably secures frame 28 within each. In alternate embodiments envisioned still within the framework of the present invention, frame 28 may extend out to the sides of hip belt 26 for dispersion of load about the belt.

Figure 3B:
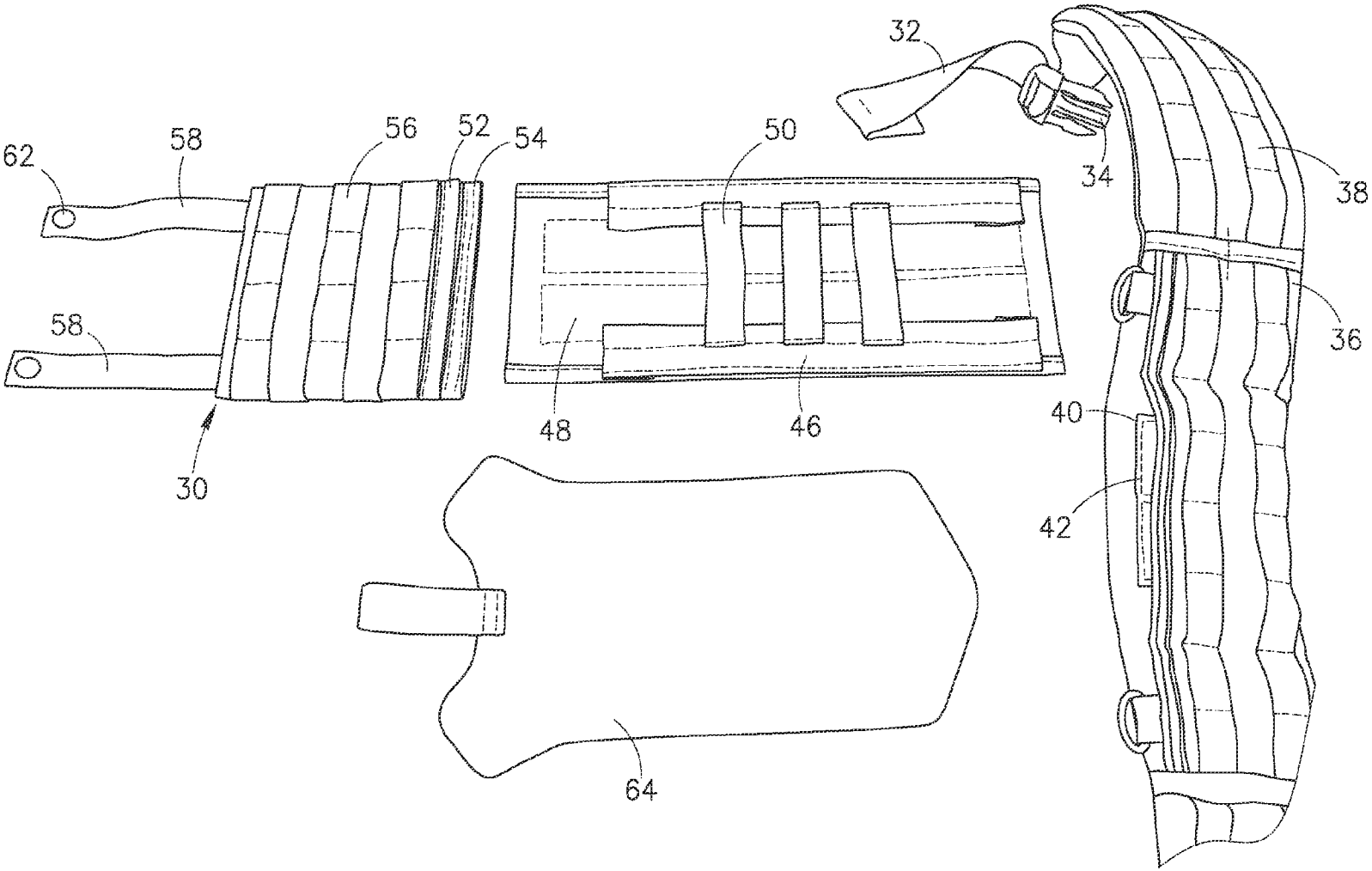
FIG. 3*b* is a rear exploded view of the harness.
Figure 4:
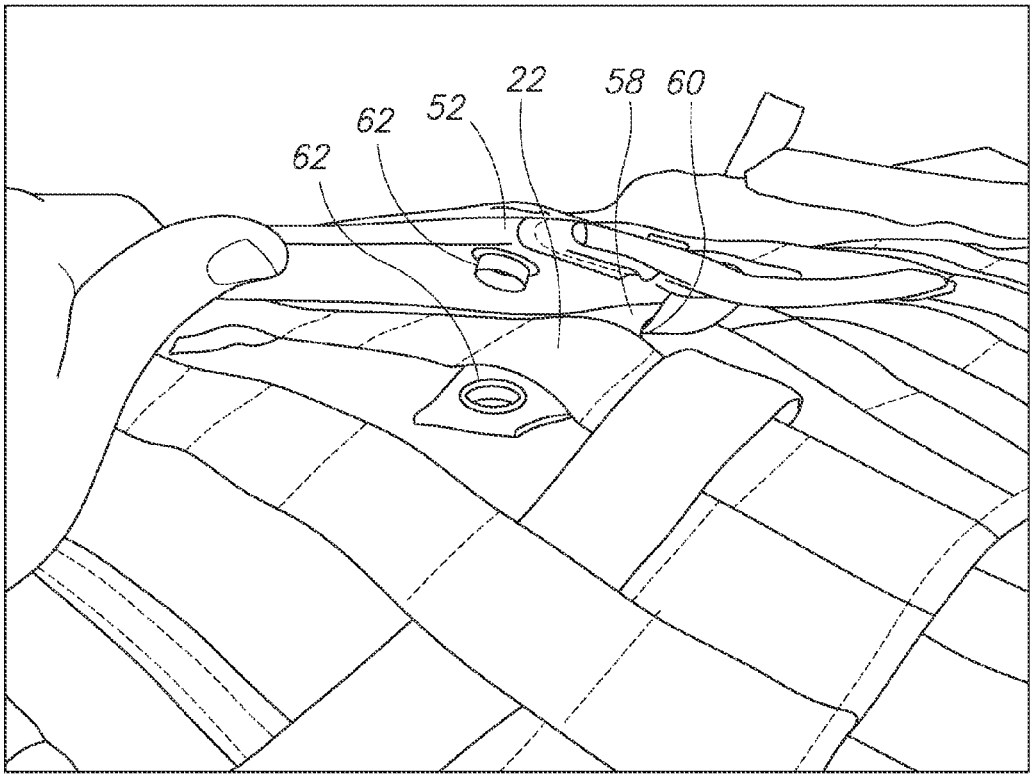
FIG. 4 is a perspective view of the upper coupler being attached to the armor shell loops.
Figure 5:
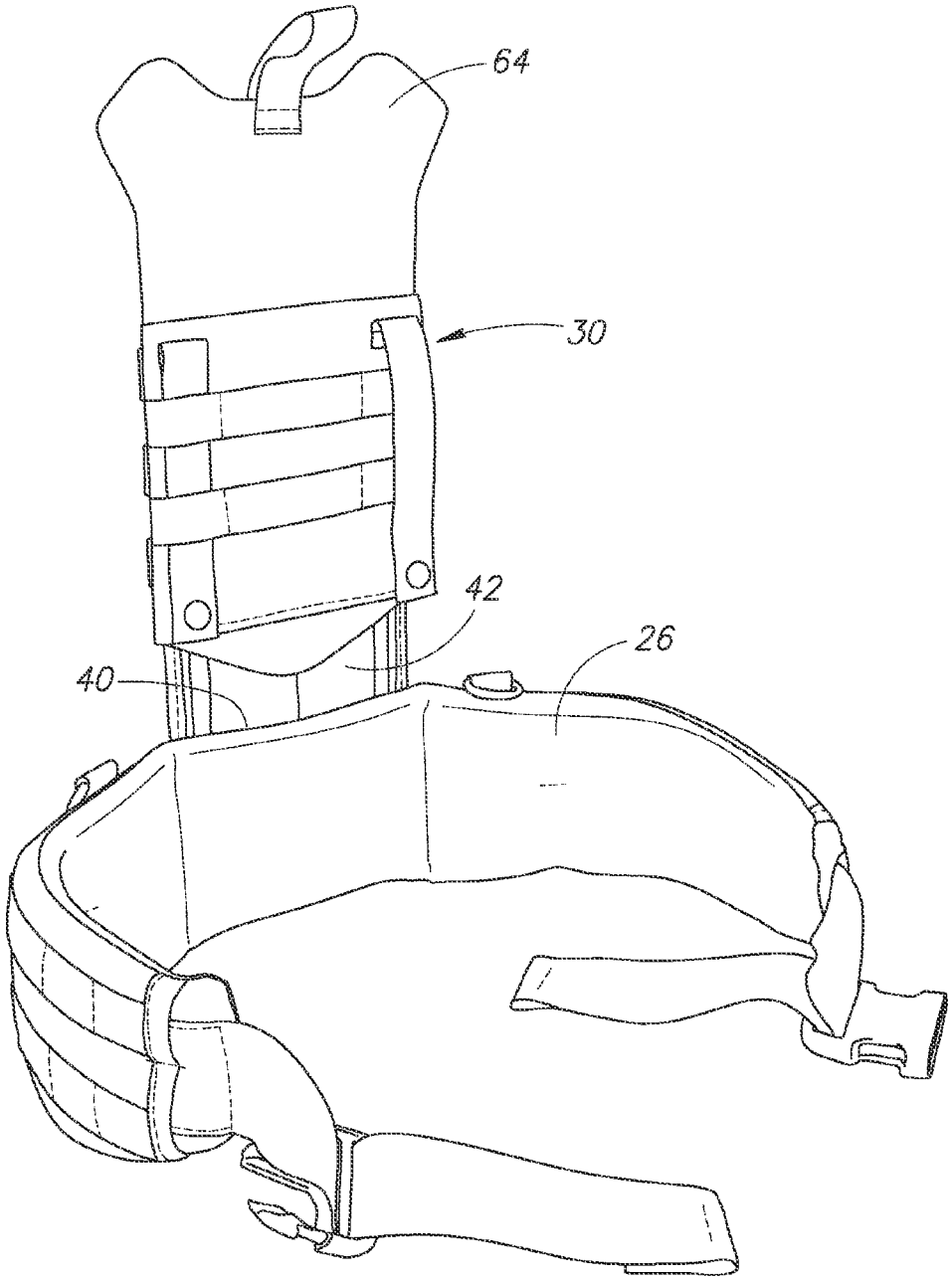
FIG. 5 is a rear perspective view of the harness being adjusted.

Coupler 30 is also supported with a frame sheet of plastic material forming a rectangular shape with a fabric cover. It is dimensioned to receive the upper end of frame 28 with a coupler sleeve 52 that preferably is open at both its upper and lower end. With this configuration, frame 28 has a wide range of vertical adjustability relative to coupler 30. A coupler fastener 54, preferably hook-and-loop fastener, is secured within sleeve 52 to join to the fastener on the front side of frame 28. As seen in FIGS. 2*a* and 3*b*, the backside of coupler 30 also includes attachment loops 56. The front side includes securement straps 58 and securement loops 60, similar to attachment loops 56. Straps 58 are fixed to the top of the coupler cover. They are constructed of woven nylon and include snaps on the ends thereof. Alternatively, other end fasteners may be used. In some cases, no fasteners at all at the ends of the straps are necessary. The snaps have mating snaps on the lower corner of the front face of coupler 30. Coupler 30 is fastened to the back of rear plate carrier 14 by intertwining straps 58 with attachment loops 22 in a preferred position for a particular user. The position will generally be in the lower middle portion of the back of rear plate carrier 14, then vertical fine-tuning adjustments can be made with the positioning of coupler 30 on frame 28. Once straps 58 are laced through attachment loops 22 and securement loops (back and forth one through the other) as shown in FIG. 4, snaps 62 are secured together. This form of attachment can sustain large loads and can be secured onto standard loops without tools. It allows the option of adding the support harness or leaving it off. Coupler 30 may remain on the armor such that frame 28 is simply secured to coupler 30 when support is desired, or coupler 30 may be completely removed.

Removal of frame 28 from hip belt 26 and from coupler 30 is preferably accomplished by separating the hook-and-loop fastener with an adjustment separator 64. Separator 64 is a sheet of semi-rigid plastic having a width at least that of the hook-and-loop fastener. When slid between the hook side and loop side of the fastener, it separates the fastener and allows relative movement between the frame and the coupler or between the frame and the hip belt. Once the frame is in the desired position relative to the coupler or hip belt, separator 64 is removed, allowing the fastener to connect. Such hook-and-loop fasteners are extremely strong in sheer, such that the set position is secure and loads may be transferred through the frame without slippage at the fastener interface. Separator 64 may be smaller than shown herein. As long as the function of separating the hook-and-loop fastener, alternate shapes and sizes may be employed. Depending on the shape and size of separator, it may be carried as part of the frame or coupler. Furthermore, alternative fastening mechanisms may be used rather than hook-and-loop fasteners.

While the preferred embodiments of the invention have been illustrated and described, as noted above, many changes can be made without departing from the spirit and scope of the invention. For example, coupler 30 may simply be a part of frame 28 to be secured to the back of the body armor when desired, instead of a separate piece. A sewn-in coupler may alternatively be part of the body armor vest envelope. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A harness that supports body armor having a back protective element with a forward facing side facing a back of a user and a rearward facing side facing away from the user, the harness comprising:

a hip belt having a rear portion, a clasp configured to secure the harness about the user, and a pad configured to provide cushioned positioning on the user, wherein the rear portion includes an opening at a top portion of the hip belt and a fastener positioned within the opening;

a coupler that is attached to the body armor on the rearward side of the back protective element; and a frame that includes a lower frame portion received in the opening at the top portion of the rear portion of the hip belt and attached to the fastener within the opening to couple the frame to the hip belt and another frame portion that is secured to the coupler and configured to extend adjacent the rearward facing side of the back protective element such that the fastener transfers at least a portion of a load from the body armor to the hip belt and the back protective element includes an armored element and is configured to be disposed intermediate the back of the user and the frame when the pad provides cushioned positioning on the user.

2. The harness of claim 1, wherein the frame is adjustably secured to the coupler, the coupler being positionable in a plurality of vertical positions relative to the frame and to the hip belt.

3. The harness of claim 1, wherein the frame is adjustably secured to the hip belt, the frame being positionable in a plurality of vertical positions relative to the hip belt.

4. The harness of claim 1, wherein the frame includes frame stays extending generally vertically along most of the length of the frame, the frame stays being flexible.

5. The harness of claim 4, wherein the frame stays comprise composite material.

6. The harness of claim 1, wherein the frame includes a plastic panel at least partially covered by a fabric.

7. The harness of claim 1, wherein the coupler comprises a sleeve into which the frame is secured.

8. The harness of claim 1, wherein the rearward facing side of the armor is coupled to attachment loops and wherein the coupler includes strips that extend through the attachment loops to secure the coupler to the armor.

9. The harness of claim 1, wherein the coupler includes a sleeve into which the frame extends, the coupler including a semi-rigid panel supporting a shape of the coupler.

10. The harness of claim 1, wherein the hip belt includes a sleeve that includes the opening that receives the lower frame portion.

11. A harness that supports body armor having front and back protective plates enveloped in a cover, the cover having a back panel over a rear of the back protective plate, the back panel having attachment loops, the harness comprising:

a hip belt that includes a clasp configured to secure the harness about a user and a pad configured to provide cushioned positioning on the user, wherein a rear portion of the hip belt includes an opening at a top portion of the hip belt and a fastener positioned within the opening; and a frame that includes a lower frame portion that is received in the opening at the top portion of the rear portion of the hip belt and attached to the fastener within the opening to couple the frame to the hip belt and another frame portion extending upwardly from the hip belt and having a support structure and a coupler structure that secures the body armor cover to the another frame portion such that the fastener transfers at least a portion of a load from the body armor to the hip belt and the back protective plate is configured to be disposed intermediate the user's back and the frame when the pad provides cushioned positioning on the user.

12. The harness of claim 11, wherein the hip belt includes a sleeve that includes the opening that receives the lower frame portion.

13. The harness of claim 12, wherein the fastener positioned within the opening is a hook-and-loop fastener and the frame is adjustably securable within the hip belt sleeve with the hook-and-loop fastener.

14. The harness of claim 11, wherein the frame coupler structure is adjustable relative to the hip belt.

15. The harness of claim 14, wherein the coupler structure includes another sleeve into which the frame extends, the frame being secured within the another sleeve of the coupler structure with another hook-and-loop fastener.

16. The harness of claim 15, wherein the coupler structure includes a plastic panel that supports a shape of the coupler structure.

17. The harness of claim 11, wherein the frame includes vertically extending frame stays.

18. The harness of claim 17, wherein the frame further includes a plastic panel extending along the frame stays and supporting a shape of the frame.

19. The harness of claim 11, wherein the coupler includes strips sized to fit within the attachment loops of the back panel and connect thereto.

20. The harness of claim 19, wherein the coupler further includes other attachment loops disposed on an outer face thereof.

21. A harness that supports an upper body armor, the body armor having a rear armor plate held within an outer shell having a rear face, at least a portion of the rear face of the outer shell having attachment loops, the harness comprising:

a hip belt securable about the hips of a user of the body armor, the hip belt having a rear portion, a clasp configured to secure the harness about the user, and a pad configured to provide cushioned positioning on the user, wherein the rear portion includes an opening at a top portion of the hip belt and a fastener positioned within the opening;

a coupler having strips that fit through the attachment loops and secure the coupler to the rear face of the armor outer shell; and a frame having a lower end and an upper end adjustably secured to the coupler, the lower end being received by the opening at the top portion of the rear portion of the hip belt and secured to the fastener within the opening to couple the frame to the hip belt, the frame including a support structure such that the fastener transfers at least a portion of a load from the body armor to the hip belt and the rear armor plate is configured to be disposed intermediate the user's back and the frame when the pad provides cushioned positioning on the user.

22. A harness that supports body armor having a back protective element with a forward facing side facing a back of a user and a rearward facing side facing away from the user, the harness comprising:

a hip belt having a first sleeve in a rear portion, a clasp configured to secure the harness about the user, and a pad configured to provide cushioned positioning on the user;

a frame having a frame sheet with an upper and a lower end, the lower end of the frame sheet is received by and coupled to the first sleeve in the rear portion of the hip belt, the frame sheet being configured to extend adjacent the rearward facing side of the back protective element such that at least a portion of a load from the body armor is transferred to the hip belt and the back protective element is configured to be disposed intermediate the back of the user and the frame; and a coupler having a plurality of straps and a second sleeve that is open at both an upper and a lower end of the coupler, the coupler being configured to receive the upper end of the frame sheet through the lower end and out of the upper end of the second sleeve such that the coupler is configured to be secured to a front side of the upper end of the frame sheet and the coupler is configured to be attached to the body armor by intertwining the plurality of straps with attachment loops positioned on the rearward side of the back protective element.

23. The harness of claim 22, wherein the frame is adjustably secured to the coupler, the coupler being positionable in a plurality of vertical positions relative to the frame and to the hip belt.

24. The harness of claim 22, wherein the frame includes frame stays extending generally vertically along most of the length of the frame, the frame stays being flexible.

25. The harness of claim 24, wherein the frame stays comprise composite material.

26. The harness of claim 22, wherein the frame includes a plastic panel at least partially covered by a fabric.

* * * * *